United States Patent [19]

Fineberg et al.

[11] 4,445,572

[45] May 1, 1984

[54] UNRESTRICTED BORE SAFETY JOINT

[75] Inventors: Douglas H. Fineberg, Tulsa, Okla.; Andrew Haynes, Missouri City, Tex.

[73] Assignee: Baker International Corporation, Orange, Calif.

[21] Appl. No.: 293,576

[22] Filed: Aug. 17, 1981

[51] Int. Cl.[3] ..... E21B 23/00

[52] U.S. Cl. ..... 166/188; 166/242; 166/382; 166/217; 285/2; 285/39

[58] Field of Search ..... 285/2, 3, 39; 166/188, 166/382, 242, 376, 237

[56] References Cited

U.S. PATENT DOCUMENTS 4,285,533 8/1981 Silberman et al. ..... 285/2

*Primary Examiner*—William F. Pate, III
*Assistant Examiner*—Hoang C. Dang
*Attorney, Agent, or Firm*—Norvell & Associates

[57] ABSTRACT

An apparatus, such as a shear-out safety joint, which is incorporated in a subterranean well tubing string for separating or severing the tubing string when subjected to excessive loads is disclosed. The shear-out safety joint is used with a safety valve and by providing a prescribed failure point will ensure that the safety valve remains intact. The apparatus includes inner and outer telescoping members which can separate when the tubing above and below the joint moves in opposite directions. A shear ring connecting the two telescoping members will shear when a predetermined load is applied. The joint also has a second releasable connecting member extending through the inner telescoping member and engaging the outer telescoping member which will support a load greater than that which can be carried by the shear ring. A longitudinally shiftable member, movable within a recess, holds the second connecting member in engagement but disengages the second connecting member when moved to a second position.

32 Claims, 5 Drawing Figures

UNRESTRICTED BORE SAFETY JOINT

BACKGROUND OF THE INVENTION

1. Field of the Invention:

This invention relates to a method and apparatus for selectively carrying first and second longitudinal loads in a tubing string in a subterranean well, with the apparatus selectively separating and severing the tubing string when the second weight load is exceeded.

2. Description of the Prior Art:

In the production of petroleum fluids, such as oil and/or gas, from wells, it has been the practice to provide automatically closing shutoff or safety valves which are located downhole and are held open by control fluid pressure. The valves automatically close when control fluid pressure is reduced. When damage occurs to the control fluid system at the wellhead or on an offshore platform, the reduction in control fluid pressure results in the valve closing. Such valves are employed below the wellhead and, in the case of offshore wells, the valves are installed below the mud line at such depth as may be desired or established by regulation. In the event of damage of a well caused by shifting earth or subsidence, or wellhead catastrophe, the well can be shut-in to avoid loss of valuable well fluids into the water, and also to avoid contamination of the water and the shore.

Since, from time to time, it is necessary to perform various remedial operations through the tubing string, it is preferred that the safety valves be easily removable from the well for service or repair. Accordingly, commercially available safety or shutoff valves have been produced which have been run into the well casing on production tubing and landed in a tubing hanger which supports the greater weight of the downwardly extending production tubing strings. Typically, such a tubing string has been run into the well casing on a setting tool to a desired depth and, in the case of an offshore well, it is to a prescribed depth below the mud line. In such an apparatus the tubing hanger is anchored in the well casing and the setting tool is released from the tubing hanger and removed from the well. The tubing hanger provides a seat for the safety or shutoff valve assembly which is run into the well on an upward extension of the production tubing and landed in the tubing hanger, subsequent to the setting of the hanger and retrieval of the hanger setting tool.

Typical of such prior art apparatus is as disclosed in U.S. Pat. No. 3,771,603, issued Nov. 3, 1973, entitled "Dual Safety Valve Method and Apparatus", to Talmadge L. Crowe. The necessity of two trips into the hole with work strings and/or other means to first carry an anchoringly set the tubing hanger and thereafter land the conduits containing the safety valves therein, is an economic problem. Considerable rig time is expended in running a first work string and/or other means for anchoring the hanger, retrieving the work string, and thereafter running the production tubing containing the safety valve or valves into sealing engagement with the hanger.

The use of a shear-out safety joint incorporable within the tubing string which will support the loads imposed by the tubing extending therebelow would alleviate this provblem. Shear-out safety joints are intended, however, to fail when subjected to longitudinal loads generally less than the weight of the tubing.

U.S. Pat. application, Ser. No. 036,910, filed May 7, 1979, discloses a shear-out safety joint used with a tubing hanger. That safety joint has a wireline retrievable interior bridge. A double collet secures the bridge and the joint together so that a weight load in excess of the desired shear-out load which can be carried across the tool will result in separation of the upper and lower tubing string. The double collet member has outwardly facing dogs which engage cooperating recesses on both the upper and lower relatively movable sections of the shear-out safety joint. The collet is removable by wireline techniques, thus leaving the two telescoping members secured only by shear pins capable of carrying a prescribed shear load. After the collet is removed and this prescribed shear load is exceeded, the shear-out safety joint will separate.

SUMMARY OF THE INVENTION

This invention comprises an apparatus, such as a shear-out safety joint, incorporable in a conduit, such as a well tubing string, which will separate the tubing string at a prescribed point when subjected to a predetermined longitudinal force. The apparatus comprises a first inner telescoping member and a second outer telescoping member. The telescoping members are connected by a first connecting member in the preferred embodiment comprising a shear ring which will separate or fail when subjected to a predetermined shear force. A second connecting member extending through the inner telescoping member and engaging the outer telescoping member will, in the engaged position, support greater load than can be supported by the first connecting member. In the preferred embodiment of this invention, this second connecting device comprises a tapered dog. This second connecting device is releasable and is held in position by a longitudinally shiftable member which engages the second connecting member on the interior thereof. This longitudinally shiftable member moves within a recess on the interior of the apparatus and leaves the internal bore of the apparatus unrestricted. Movement of the shiftable member releases the second connecting device and the load carrying capacity of the joint is reduced to that which can be carried by the first connecting member. Full load carrying capacity may, however, be restored by insertion of an inner cylindrical sleeve.

DESCRIPTION OF THE PREFERRED EMBODIMENT

Figure 1:
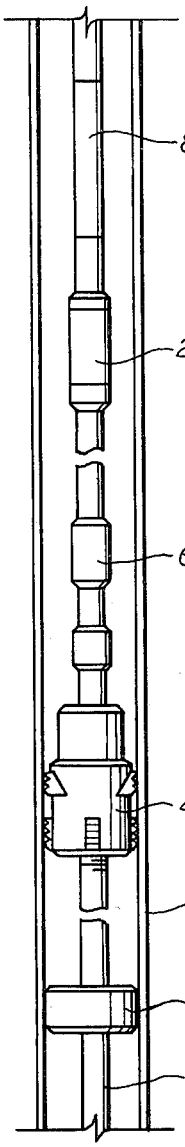
FIG. 1 depicts a single string tubing hookup in which a shear-out safety joint is used in conjunction with a hanger and safety valve.

The invention described herein comprises means for connecting upper and lower components such as portions of a tubing string in a subterranean well. Apparatus incorporating this invention permit the connection between upper and lower components to be broken when the apparatus is subjected to a predetermined longitudinal load. The apparatus can, however, be repeatably set to carry loads in excess of this predetermined load. The apparatus having these capabilities has numerous applications, including use as a shear-out safety joint in an oil well tubing string incorporating conventional tubing hangers. FIG. 1 is a schematic representation of a typical tubing hookup in an offshore oil well. A tubing hanger 4 engages the casing 10 to support that portion of the tubing string 8 extending below the hanger. A safety valve 6 is mounted in the tubing string and guards against unrestricted flow of the production fluids through the tubing string to the surface. A shear-out safety joint 2 is employed in the tubing string 8, or conduit above the safety valve, and, in effect, provides a designated failure joint at which the tubing will separate in the event of a catastrophe at the wellhead. Failure of the shear-out safety joint will leave the conventional safety valve, such as, for example, the valve shown in U.S. Pat. No. 3,771,603, intact. A safety valve comprising a valve head and seat will close the tubing preventing produced fluids from flowing to the surface.

The tubing hookup depicted in FIG. 1, or a similar dual-string hookup, would be run into the well with the hanger attached both to the production tubing above and below the hanger 4. During running in the tubing string above the hanger would carry the load of the hanger 4 and the tubing string depending from the hanger. A shear-out safety joint 2 would necessarily have to carry this longitudinal load during running in. After the tubing string is run in, the hanger 4 may be set with anchoring means such as conventional slips engaging the casing to support the tubing therebelow. At this point, the shear-out safety joint could be activated for carrying only a lesser predetermined load prior to failure.

Figure 2:
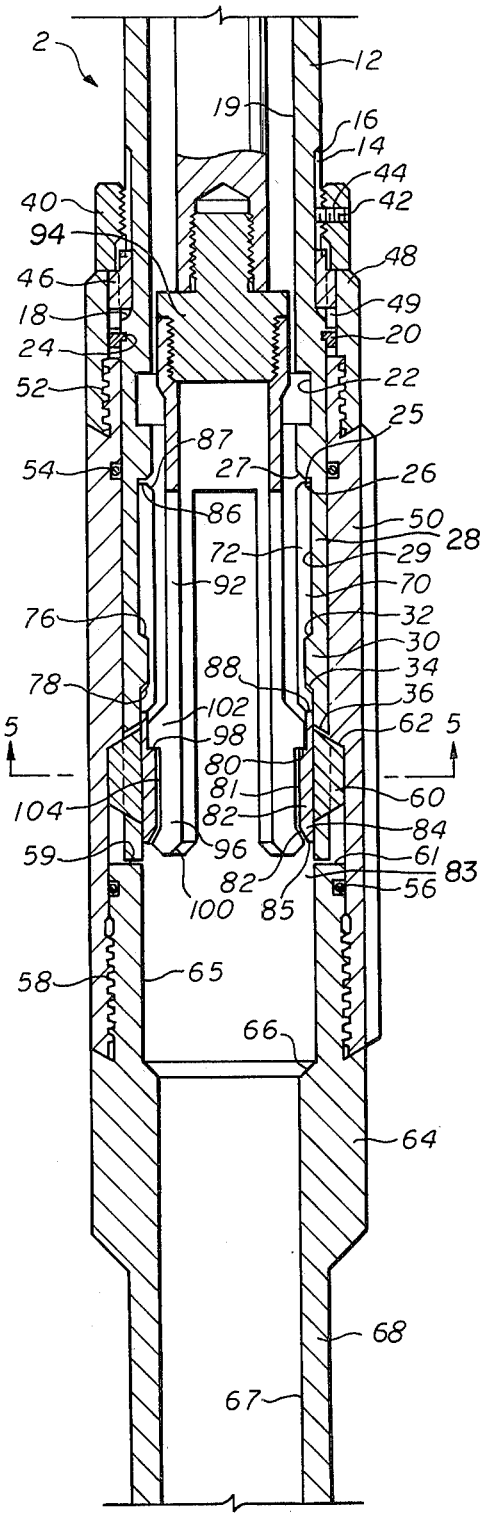
FIG. 2 is a longitudinal section view showing the components of the shear-out safety joint prior to arming the shear-out safety joint.
Figure 5:
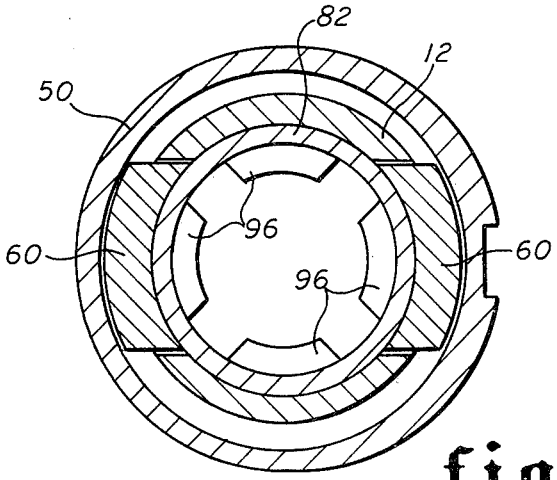
FIG. 5 is a section view showing the joint in its initial activated configuration.

The principal components of the shear-out safety joint 2, shown in FIG. 2, are the upper body 12, the lower body 64, a bridging segment 50 extending therebetween, a locking dog 60, a longitudinally shiftable collet 70, and a shear ring 20. As shown in FIG. 2, the collet 70 holds locking dog 60 in engagement with bridging segment 50, attached both to lower body 64 and to the upper body 12. If locking dog 60 is free to move radially inward, the entire load of the tubing string below the shear-out safety joint 12 will be carried only by the shear ring 20. The shear-out safety joint 2 can be attached by means of conventional threads, not shown, to the portion of the tubing string 8 extending above the shear-out safety joint 2. Upper body 12 consists of an elongated cylindrical member having an inner bore or central flow passage 19 of sufficient inner diameter to permit the free passage of fluids through shear-out safety joint 2. Ideally, this inner bore would be equivalent to that of the tubing string. Spaced from the upper end and along the exterior of upper body 12 is a longitudinally extending groove 14 having a curved upper end 16 and a curved lower end 18. The outer diameter of upper body member 12 below recess 14 is greater than the corresponding outer diameter above recess 14. Immediately below recess 14, an annular groove 24 extends around upper body 12. This groove 24 is adapted to receive a shear ring 20. Along the inner surface of upper body 12 is another annular groove 22. Groove 22 is adapted to receive a dog on a conventional oil well locking member. Spaced longitudinally below grooves 22 and 24 is an inwardly extending shoulder 26, having a first inclined surface 27 and a second perpendicular surface 25. An oppositely facing inclined shoulder 32 is spaced longitudinally below shoulder 26 and the inner diameter of upper body 12 along upper body mating section 28 between shoulders 26 and 32 is greater than the inner bore 19 of upper body 12. An inwardly extending annular ring 30 extends between upwardly facing inclined shoulder 32 and a downwardly facing perpendicular shoulder 34. The portion of the mating section 28 of upper body 12 extending below shoulder 34 has an inner diameter generally equivalent to the inner diameter of that section between shoulders 26 and 32. One or more radially extending recesses 36, having both upwardly and downwardly facing inclined surfaces, extends into mating section 28 of upper body 19, adjacent its lower end.

An outer bridging segment 50 emcompases the lower mating section 28 of upper body 12. Bridging segment 50 is attached to lower body 64 by means of a threaded connection 58 at its lower end. Bridging segment 50 is normally fixed relative to the upper body by means of shear ring 20. As shown in FIG. 2, shear ring 20 fits within an annular groove 24 on the outer surface of the upper body 12. Shear ring 20 is held in annular groove 24 by a torque ring 48 located immediately above shear ring 20. Torque ring 48 is attached to bridging segment 50 by means of a threaded connection 52 at the upper end of bridging segment 50. A plurality of keys 46 extend into longitudinal grooves 14 on upper body 12. These keys also extend into longitudinally extending cooperating grooves within torque ring 48. The keys are held in position relative to upper body 12 by means of an upper retainer nut 40 which is, in turn, fixed relative to upper body 12 by means of a retainer pin 42 extending through a hole 44 in nut 40. Torque ring 48 engages shear ring 20 by means of an inwardly extending annular ring 49. The engagement of annular ring 49, an integral part of torque ring 48 with shear ring 20, which constitutes a first connecting member, will prevent longitudinal movement of upper body member 12 relative to bridging segment 50. The engagement of torque ring 48 with keys 46 also permits rotational movement to be transmitted through upper body member 12 to lower body 64.

O-ring seals 54 and 56, located along the lower surface of bridging segment 50, provides sealing integrity between the bridging segment 50 and the upper body member 12 and the lower body member 64, respectively. Bridging segment 50 is threadably engaged with the lower body segment 68 by means of threads 58. Bridging segment 50 has an inwardly inclined shoulder or surface 62 which engages a tapered dog 60 adjacent the engagement of dog 60 with the mating portion 28 of the upper body 12. The engagement between bridging segment 50 and dog 60 occurs between O-ring seals 54 and 56. Since bridging segment 50 and lower body member 64 are rigidly attached, lower body member 64 is held in place by dog 60 in the configuration shown in FIG. 2. Lower body member 64 is, in turn, attached to elements in the tubing string extending below the shear-out safety joint by means of a conventional connection (not shown) located at the lower end of section 68 of lower body member 64.

The inner surface 65 of lower body member 64 has an inner diameter equivalent to the inner diameter 29 of mating section 28 of the upper body member 12. An inwardly inclined and upwardly facing shoulder 66 is spaced longitudinally below the upper end of lower body member 64. Shoulder 66 extends between inner surface 65 and the lower inner bore 67 of the shear-out safety joint 2. Lower bore 67 is equivalent to the upper bore 19.

A cylindrical shifting collet 70 is mounted along the lower surface of mating section 28 in the configuration shown in FIG. 2. Shifting collet 70 has a rigid cylindrical retaining sleeve 82 located at its lower end. In the configuration of FIG. 2, the retaining sleeve 82 is positioned immediately beneath dog 60 and the cylindrical retaining sleeve 82 urges dog 60 radially outward into engagement with mating section 28 and bridging member 50. A plurality of flexible collet arms or members 72 extend upwardly from cylindrical sleeve member 82. These collet arms 72 are spaced apart and the shoulder 88 extends between adjacent flexible collet arms 72. A second perpendicular shoulder 80 is located below shoulder 88 on the inner surface of retaining sleeve 82. The outer edge of shoulder 80 merges with an inner surface 81 on retaining sleeve 82. Inner surface 81 preferably has the same internal diameter as the upper and lower internal bores 19 and 67, respectively, of the shear-out safety joint 2. The lower or leading edge 84 of retaining sleeve 82 is formed by an inner inclined surface 83 which merges with a perpendicular section 85. Along the opposite end of shifting collet 70 the trailing edge of each flexible arm 72 comprises an inner inclined surface 87 which merges with a perpendicular surface 86.

The central portion of the shifting collet 70 has a recess along its outer surface, flanked by shoulders 76 and 78. In the configuration of FIG. 2 this annular recess receives a cooperating annular ring 30 on bridging segment 50.

Figure 3:
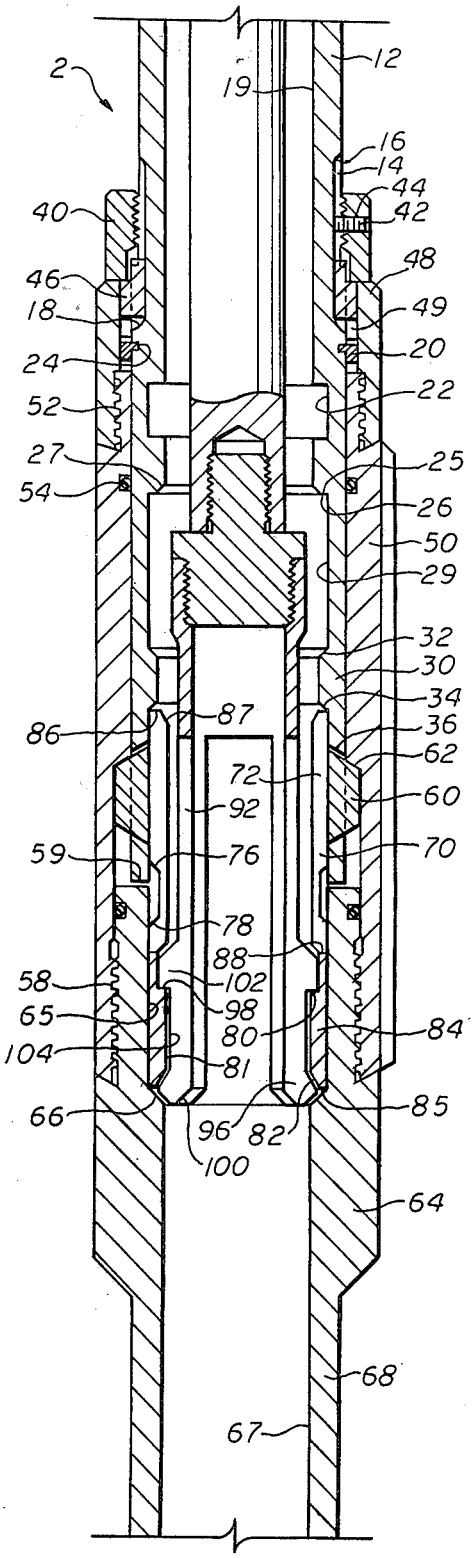
FIG. 3 is a view similar to FIG. 2 but showing the shear-out safety joint in the activated position so that a load in excess of a prescribed load will result in failure at the shear-out safety joint.

A separate shifting tool 92 is used to move shifting collet 70 from its first position shown in FIG. 2 to its second position shown in FIG. 3. The shifting tool comprises an upper shifting tool sub 94 and a shifting tool arms 96 attached thereto. The shifting arm has an inwardly extending shoulder 98 which extends perpendicular to arm 96. Shoulder 98 comprises the lower end of an outwardly extending finger 102. Immediately below perpendicular shoulder 98 is a recess section 104 which merges with a lower camming section 100, located at the leading edge of the shifting tool 92.

Activation of this shear-out safety joint occurs when the shifting tool 92, which comprises a wireline tool, is moved so that shoulder 98 on the shifting tool engages perpendicular shoulder 80 on the inner surface of retaining sleeve 82. As the shifting tool 92 is moved downwardly, the flexible collet arms 72 are cammed inwardly by the action of inclined surface 76 along annular ring inclined surface 32. The entire shifting collet 70 can then be moved down with the retaining sleeve moving along the inner surface 65 of lower body member 64. The shifting tool moves the collet down until shifting collet 70 is in the position shown in FIG. 3, with its leading edge immediately adjacent the inclined surface 66 on lower body member 64. In the position shown in FIG. 3, dogs 60 are no longer retained in place by the cylindrical collet sleeve 82, but are now held in position only by the flexible arms 72. Any significant force tending to move upper body member 12 away from lower body member 64 will tend to cam dog 60 inward against flexible arms 72 to release the engagement between bridging segment 50 and each dog 60. When the shifting collet 70 is in the position shown in FIG. 2, both dogs 60, comprising a second connecting member in its engaged position in engagement with bridging segment 50 and the upper body member 12 and shear ring 20, will hold the shear-out safety joint together. Note that in this position, any force tending to move the upper telescoping body 12 relatively toward the lower telescoping assembly comprising bridging segment 50 and lower body 64, will urge lower body shoulder 61 into abutment with upper body shoulder 59.

In the configuration of FIG. 3, the presence of flexible arms 72 substantially limits the load carrying capacity of dogs 60. In the configuration of FIG. 3, the shear ring 20 provides the principal, if not the only, significant means of holding the shear-out safety joint together. Since shear ring 20 can be manufactured so that it will withstand only a prescribed shear force, the longitudinal load at which shear-out safety joint 2 will fail, can be predetermined by utilizing a shear ring 20 having the appropriate shear value. The shear-out safety joint, in the configuration of FIG. 3, would be in the activated or running position and the well would be operated while the shear-out safety joint is in this position (after removal of shifting tool 92). Although shear ring 20 does not support significant tubing weight in the configuration of FIG. 3, there are longitudinal forces acting on the shear ring 20 during normal operation. For example, a pressure differential acting on inner body member 19 results in a force which will act on shear ring 20.

Figure 4:
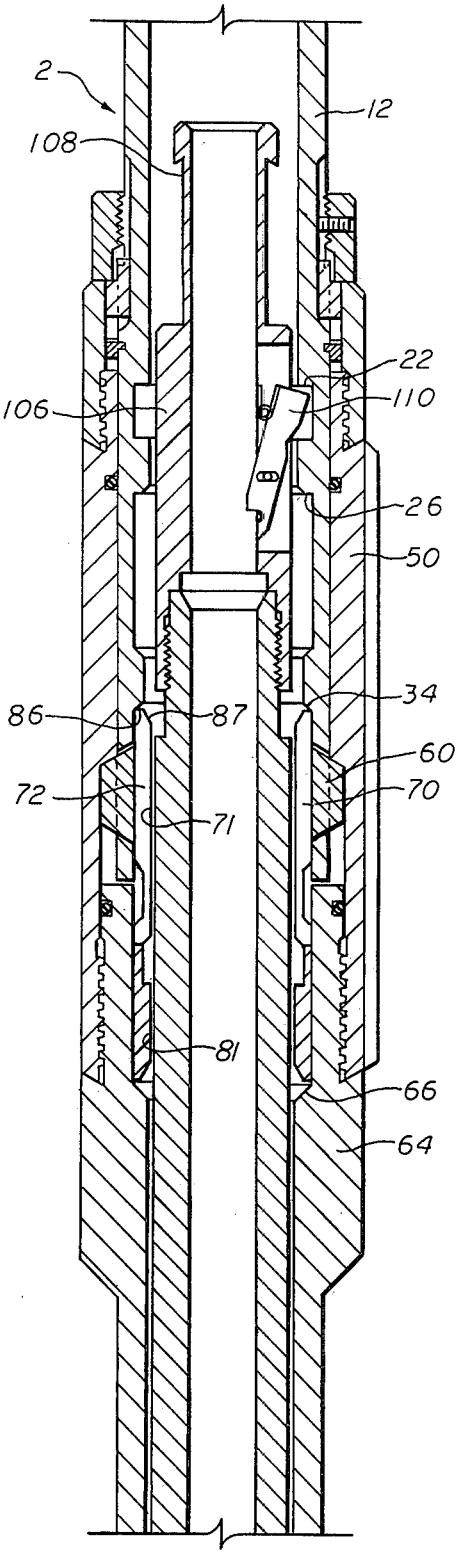
FIG. 4 shows the shear-out safety joint restored to full load-carrying capacity.

If it were to become necessary to disengage hanger 4 and remove tubing 8, it could not be assumed that the shear-out safety joint 2 could support the entire weight of the tubing extending therebelow. The shear force at which ring 20 would fail generally be less than the weight of the lower tubing string 8. The preferred embodiment of this invention comprises means for restoring the shear-out safety joint to full load carrying capability, as evidenced by the configuration of FIG. 4. This shear-out safety joint can be restored to full load carrying capacity by inserting a second inner cylindrical sleeve 106 attached to a conventional wireline locking module 108. These conventional wireline locking modules are depicted on pages 724 and 725 of the Composite Catalogue of Oil Field Equipment and Services for 1980-1981, published by World Oil. When the wireline lock 108 is lowered to the position in which the locking dogs 110 can engage recess 22, the cylindrical sleeve 106 can be positioned immediately below flexible arms 72 on shifting collet 70. The sleeve 106 will then hold both the flexible arm 72 and the dog 60 in the radially outward position, thus holding upper body member 12 in engagement with bridging segment 50 and lower body member 64.

The shifting collet 70 cannot be disengaged by the action of any wireline shifting tool since the perpendicular shoulder 86 at the upper end of flexible arm 72 will engage a perpendicular shoulder 34 on bridging segment 50. Upward force on the shifting collet 70 will therefore not move the shifting collet past the engagement of these two perpendicular shoulders, thus inadvertently restoring the shear-out safety joint to its full load carrying capability. Only when an appropriate wireline sleeve or collar, such as sleeve 106, is positioned within dogs 60, will the shear-out safety joint be restored to its full load carrying capability, thus rendering this joint inoperable as a shear-out safety joint.

Although sleeve 106 does somewhat restrict the central flow passage in shear-out safety joint 2, the central flow passage is unobstructed during normal operation in the configuration of FIGS. 2 and 3. The shifting collet 70 moves within the recess between shoulders 26 and 66. In the preferred embodiment, the internal diameter of shifting collet 70 is equivalent to the internal diameter of the bore of the shear-out safety joint. This large bore is advantageous since it allows unobstructed flow through the tubing and shear-out safety joint. The full bore also allows the insertion of wireline equipment or plugs through the safety joint into the tubing below without interposing any obstruction. Such a conventional packer would be located below the hanger 4 and when set, the packer will packoff the tubing-casing annulus and isolate the production zone from the tubing-casing annulus extending thereabove. Alternatively, this shear-out safety joint could be employed with a tubing hanger which employs both anchoring means to mechanically secure the hanger to the casing, but integral packoff means extending between the hanger and the casing in a conventional manner. The shear-out safety joint, comprising the preferred embodiment of this invention, thus allows unrestricted flow through the tubing in both directions, permits the application of torque through the tubing string to components located therebelow, and can support the weight of the tubing string insertion into and extraction from the well bore.

Although the invention has been described in terms of the specified embodiment, which is set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus incorporable on a conduit insertable into a subterranean well for severing said conduit at a predetermined location when subjected to a predetermined longitudinal load, said apparatus comprising:

first and second relatively telescoping members;

first connecting means for normally connecting said first to said second telescoping member and for disengaging and separating said first from said second telescoping members when subjected to said predetermined longitudinal load;

second connecting means for engaging said first telescoping member and laterally adjacently engaging said second telescoping member, said second connecting means being releasable and, when in an engaged position, retaining said first and said second telescoping members in an attached configuration when subjected to longitudinal loads in excess of said pre-determined longitudinal load, said second connecting means further comprising a member extending through a cooperating opening in said first telescoping member and engaging said second telescoping member on the exterior of said first telescoping member; and longitudinally shiftable means movable internally of said second connecting means and preventing inward movement of said second connecting means in a first position, and inwardly releasing said second connecting means when in a second longitudinally shifted position when said conduit is subjected to a longitudinal load in excess of said pre-determined force.

2. The apparatus of claim 1 wherein said second connecting means comprises a tapered member contoured to engage cooperating adjacent surfaces on said first and second telescoping members.

3. The apparatus of claim 2 wherein said tapered member engages inclined surfaces on said first and second telescoping members with relative movement between said first and second telescoping members for camming said tapered member radially inward.

4. The apparatus of claim 1 wherein said second connecting means retains said first and second telescoping members in attached configuration when subjected to forces acting to separate said first and second telescoping members, said telescoping members abutting under the action of forces acting to move said telescoping members relatively toward each other.

5. The apparatus of claim 1 wherein said longitudinally shiftable member comprises a rigid cylindrical member having inwardly relatively flexible members extending longitudinally therefrom.

6. The apparatus of claim 5 wherein said rigid cylindrical member is positioned on the interior of said second connecting means in said first position to hold said second connecting means in the engaged position.

7. The apparatus of claim 6 wherein said relatively flexible members are positioned on the interior of said second connecting means in said second position to permit inward release of said second connecting means.

8. The apparatus of claim 7 wherein said relatively flexible members comprise a collet engaging the interior of said second connecting member when said shiftable member is in said second position.

9. The apparatus of claims 1, 2, 3, 4, 5, 6, 7 or 8, wherein said first connecting means comprises a shearable member having the capacity to carry only a predetermined shear load.

10. An apparatus incorporable on a conduit insertable into a subterranrean well for severing said conduit at a pre-determined location when subjected to a pre-determined longitudinal load, said apparatus comprising:

first and second relatively telescoping members;

a first connecting member engaging said first and second telescoping member and being disengagable when said conduit is subjected to a load greater than said pre-determined load;

an internal bore defined therein and communicating with the bore in aid conduit;

a longitudinally extending recess having an internal diameter greater than the diameter of said internal bore;

a shiftable member, longitudinally movable within said recess between first and second positions, the internal diameter of said shiftable member being equal to the internal diameter of said internal bore; and a second connecting member extending through said first inner telescoping member into engagement with said second outer telescoping member with said shiftable member abutting said second connecting member and maintaining engagement between second connecting member and said outer telescoping member in said first position, engagement between said second connecting member and said first and second telescoping members being maintained when said conduit is subjected to longitudinal loads greater than said pre-determined longitudinal load when said shiftable member is in said first position, relative movement between said inner and outer telescoping members urging said second connecting member inward when said shiftable member is in second position.

11. The apparatus of claim 10 wherein said shiftable member is longitudinally movable from said first to said second position and is not movable from said second position to said first position.

12. The apparatus of claim 11 wherein said shiftable member further comprises a plurality of inwardly flexible members, said flexible members engaging the interior of said second connecting member when said shiftable member is in said second position.

13. The apparatus of claim 12 wherein said inner telescoping member has an inner annular ring in said recess.

14. The apparatus of claim 13 wherein said flexible members are cammed inwardly by said annular ring to permit movement of said shiftable member from said first to said second position.

15. The apparatus of claim 14 wherein the ends of said inwardly flexible members engage said annular ring to prevent movement of said shiftable member from said second to said first position.

16. The apparatus of claims 10, 11, 12, 13, 14 or 15, wherein said second connecting member comprises a tapered member with relative movement between said first and second telescoping member camming said tapered second connecting member radially inward.

17. The apparatus of claims 10, 11, 12, 13, 14 or 15, wherein said first connecting means comprises a shearable member having the capacity to carry only a predetermined shear load.

18. The apparatus of claims 10, 11, 12, 13, 14 or 15, further comprising locking groove means for engaging an insertable sleeve means positioned to locate said sleeve means internally of said second connecting means to prevent release of said second connecting means when in said second position.

19. An apparatus incorporable on a tubing string for producing fluids from a production zone in a subterranean well in which casing is set below the top of the well, said apparatus comprising tubing hanger means supporting the portion of said tubing string extending therebelow upon engagement of said tubing hanger means with said casing; said tubing hanger means engaging and being supported by that portion of the tubing string extending thereabove prior to engagement of said tubing hanger means with said casing; the improvement comprising a shear-out safety joint, incorporable in the portion of said tubing string above said tubing hanger means, further comprising:

a central flow passage communicable with tubing string and having an unobstructed internal bore equivalent to the bore of said tubing string;

first connecting means being disengageable when said tubing is subjected to a predetermined longitudinal load to separate said tubing string at a predetermined location;

second releasable connecting means for carrying in an engaged position a load equal to the weight of the tubing string extending below said shear-out safety joint and in excess of said predetermined longitudinal load; and longitudinally shiftable means having an internal bore equivalent to the internal bore of said central flow passage and movable between a first position for holding said second connecting means in said engaged position and a second position in which said second connecting means is releasable.

20. The apparatus of claim 19 wherein said longitudinally shiftable means is movable from said first to said second position and is engaged upon movement to said second position to prevent movement from said second to said first position.

21. In the apparatus of claim 20 wherein said longitudinally shiftable member moves within a recess having an internal diameter greater than the internal diameter of said central flow passage.

22. In the apparatus of claim 21 wherein said second connecting means is releasable by inward radial movement.

23. In the apparatus of claim 22 wherein said shear-out safety joint further comprises locking groove means for engaging an insertable sleeve means positioned to locate said sleeve means internally of said second connecting means to prevent release of said second connecting means when in said second position.

24. In the apparatus of claim 22 wherein said longitudinally shiftable member comprises a first section for engaging the interior of said second connecting means to prevent inward radial movement when in said first position.

25. In the apparatus of claim 24 wherein said longitudinally shiftable member further comprises inwardly flexible members for engaging the interior of said second connecting means when in said second position.

26. In the apparatus of claim 25 wherein said inwardly flexible members engage a shoulder to prevent movement of said longitudinally shiftable member from said second to said first position.

27. In the apparatus of claims 19, 20, 21, 22, 24, 25, 26 or 23, further comprising a safety valve having valve head and seat means capable of blocking fluid flow in said tubing string and being incorporable on said tubing string above said tubing hanger means and below said shear-out safety joint.

28. In the apparatus of claims 19, 20, 21, 22, 24, 25 or 26, further comprising a packer for isolating the annulus between said tubing and said casing above said production zone, said packer being below said tubing hanger means.

29. In the apparatus of claim 28, a packer activatable to isolate the annulus between said tubing and said casing in response to the hydrostatic pressure of fluid injected in said tubing string through said central flow passage of said shear-out safety joint.

30. In the apparatus of claims 19, 20, 21, 22, 24, 25 or 26, further comprising packoff means for establishing a seal between said tubing and said casing for isolating the annulus between said tubing and said casing above said production zone.

31. In the apparatus of claim 30 wherein said packoff means extends between said tubing hanger means and said casing.

32. An apparatus incorporable on a conduit, having a bore therethrough, insertable into a subterranean well for severing said conduit at a pre-determined location when subjected to a pre-determined longitudinal load, said apparatus comprising:

first and second relatively telescoping members with an internal bore defined therein, forming a central flow passage and communicating with the bore of said conduit;

first connecting means for normally connecting said first to said second telescoping member and for disengaging and separating said first from said second telescoping member when subjected to said pre-determined longitudinal load;

second connecting means extending into a cooperating opening in said first telescoping member for engaging said first telescoping member and laterally adjacently engaging said second telescoping member and comprising at least one radially shiftable member, said second connecting means being releasable and, when in an engaged position, retaining said first and said second telescoping members in an attached configuration when subjected to longitudinal loads in excess of said pre-determined longitudinal load; and longitudinally shiftable means movable into radial abutment with said second connecting means and preventing radial movement of said second connecting means in first position, and radially releasing said second connecting means when in a second longitudinally shifted position, said longitudinally shiftable means having an internal bore equivalent to the internal bore of said contral flow passage.

* * * * *